United States Patent [19]

Melli

[11] Patent Number: 4,563,377

[45] Date of Patent: Jan. 7, 1986

[54] HIGH-STRENGTH TUBULAR BEAM OF FOLDED CORRUGATED CARDBOARD

[75] Inventor: Ilario Melli, S. Ilario d'Enza, Italy

[73] Assignee: Finsen S.p.A., Reggio Emilia, Italy

[21] Appl. No.: 465,925

[22] Filed: Feb. 14, 1983

[51] Int. Cl.[4] ..... B65D 19/34

[52] U.S. Cl. ..... 428/36; 138/173; 108/51.3; 52/723; 229/37 E

[58] Field of Search ..... 138/173; 229/37 E; 52/723; 493/451; 428/36; 108/51.1, 51.3

[56] References Cited

U.S. PATENT DOCUMENTS 3,131,656 5/1964 Houle ..... 108/51.3
3,167,038 1/1965 Brown ..... 108/51.3
3,952,672 4/1976 Gordon et al. ..... 108/51.3
4,102,525 7/1978 Albano ..... 108/51.3

*Primary Examiner*—John E. Kittle
*Assistant Examiner*—James J. Seidleck

[57] ABSTRACT

A high-strength tubular beam of folded corrugated cardboard, for example for constructing disposable load-carrying platforms, comprising a single corrugated cardboard sheet (1) folded back several times on itself to form an overall section of right angled or isosceles trapezium form (4, 6', 8', 8, 6), divided into two adjacent rectangular or rectangular trapezium half sections (4, 6', 8', 18'), (4, 6, 8, 18), each comprising two mutually inverted triangular channel configurations (16', 14', 12')-(8', 10', 12'), (10, 8, 12)-(16, 14, 12), which mate with each other and have a common diagonal (12, 12').

6 Claims, 3 Drawing Figures

HIGH-STRENGTH TUBULAR BEAM OF FOLDED CORRUGATED CARDBOARD

This invention relates to a box beam of folded corrugated cardboard, which has high resistance to bending and to transverse crushing, and is suitable for example for constructing load resting or carrying platforms of the pallet type.

Disposable corrugated cardboard pallets are known, formed from a set of cardboard box-section beams disposed mutually crossing.

Box beam elements, of known type, are formed from two sheets of cardboard which are folded several times back on themselves to form, respectively, the actual body of the box element and a cover therefor which is fixed to this latter by gluing, and which ensures the transverse constituency of said body and improves its bending resistance. This body is in the form of a beam of parallelepiped form, constituted by two adjacent symmetrical elements, the cross-section of each of these comprising a diagonal which is locked against central abutments which rise from the base of said parallelepiped form.

Central abutments are produced by punching them from the sheet which constitutes the parallelepiped beam, and are disposed alternately on one and the other side of the axis of longitudinal symmetry of said sheet, to which they are joined along said axis of longitudinal symmetry.

The use of such box beams, for example for forming load-carrying platforms in general, has shown to possess drawbacks derived from the fact that it is necessary to prepare two separate corrugated cardboard sheets provided with respective predetermined creasing lines, in which one, i.e. that designed to form the body of the box element, must also be subjected to a punching operation for creating said central abutments.

After this, the second sheet, which has been previously folded several times back on itself, must be assembled.

The present patent provides and protects a tubular corrugated cardboard element which forms a beam suitable, for example, for constructing disposable load-carrying platforms, and is composed of a single sheet of cardboard folded back on itself several times, to provide, by way of a simple and rational constructional design, properties in the form of resistance to bending, to transverse crushing and to deformation of its cross-section which are comparatively superior to those obtainable with the aforesaid known box beams.

Moreover, because of the absence of punching operations, and by virtue of being composed of a single sheet, it can be manufactured automatically and continuously by machine, without manual intervention.

According to the present invention, the proposed tubular element is composed of a single corrugated cardboard sheet which is symmetrically folded back several times on itself to form a beam of right angled or isosceles trapezium form, this section being divided into two adjacent symmetrical half sections, each comprising two channel configurations which are connected together by a common diagonal. Suitable adhesive zones are provided in order to ensure the consistency of said complex section.

The characteristics and constructional merits of the present invention will be more apparent from the detailed description given hereinafter, with reference to the figures of the accompanying drawings which illustrate one particular embodiment thereof by way of nonlimiting example.

The figures show a corrugated cardboard sheet 1 of constant width and indeterminate length, the axes of its corrugations being orthogonal to the longitudinal axis of symmetry 2 of said sheet. The flat sheet 1 is provided longitudinally with a series of predetermined creasing lines, which are symmetrically disposed about the longitudinal axis of symmetry 2.

Figure 1:
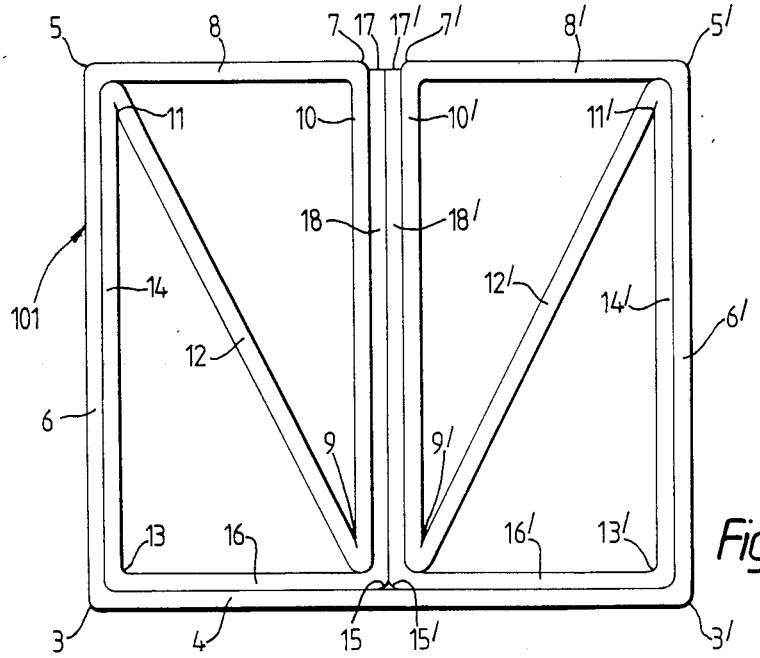
FIG. 1 is a cross-sectional through a tubular element constructed in accordance with the present invention.
Figure 2:
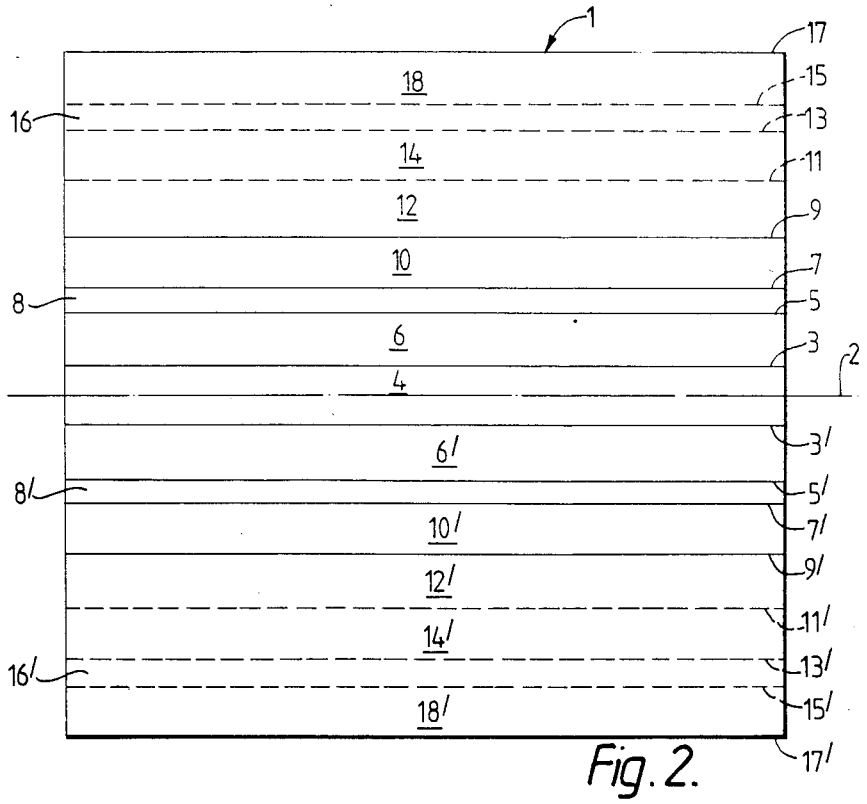
FIG. 2 shows a completely extended sheet of cardboard arranged to form the tubular element of FIG. 1.

More specifically, as shown in FIG. 2, the sheet 1 comprises two predetermined creasing lines 3 and 3', which define a central longitudinal portion 4 straddling the longitudinal axis of symmetry 2 and having a length equal to that of the tubular element 101 which is to be obtained, this latter being shown in section in FIG. 1.

The pair of lines 3 and 3' is arranged to enable the two sheet side portions lying to the side of said central portion 4 to be folded upwards. Externally to the lines 3 and 3', there are two further predetermined creasing lines 5 and 5', which with respect to their folding direction are concordant with the preceding.

Between the pairs of lines 3 and 5, and 3' and 5', there thus become defined two respective longitudinal strips 6 and 6', having a width equal to the height of the cross-section of the tubular element to be obtained (FIG. 1).

Two predetermined creasing lines 7 and 7' are provided in symmetrical positions externally to the lines 5 and 5', to define, with the aid of said lines 5 and 5', two further strips 8 and 8' respectively. The lines 7 and 7' are concordant with the lines 5 and 5', and the strips 8 and 8' have a width which is practically equal to one-half the width of the cross-section of the tubular element, less the thickness of the cardboard sheet.

Again in a symmetrical position externally to the lines 7 and 7', there are two further lines 9 and 9' concordant with the preceding, and defining two longitudinal strips 10 and 10' having a width practically equal to the thickness of the beam, less double the thickness of the cardboard sheet as shown in FIG. 1.

Symmetrical in positions external to the lines 9 and 9' there are provided a further two lines 11 and 11', which are discordant with the preceding and define two longitudinal strips 12 and 12' respectively. These strips have a width which is practically equal to the length of the hypotenuse of the right angled triangle defined by the catheti 8 and 10, or 8' and 10', as shown in FIG. 1.

Beyond the lines 11 and 11', and again in a symmetrical position, there are lines 13 and 13' which are concordant with the lines 11 and 11', and define two further longitudinal strips 14 and 14'. These latter strips have a width practically equal to that of the corresponding strips 10 and 10'.

Finally, in a symmetrical position external to the lines 13 and 13', there are two marginal longitudinal lines 15 and 15' concordant with the latter lines, and defining two strips 16 and 16' having a width practically equal to that of the strips 8 and 8' respectively.

To the side of the lines 15 and 15' there are the longitudinal edges 17 and 17' of the flat sheet 1, which define two outer strips 18 and 18' having a width practically equal to that of the strips 10 and 10', or 14 and 14'.

Starting with the flat sheet 1, the tubular element or beam 101 which is shown in FIG. 1 is obtained by successively folding said sheet following the folding directions of the aforesaid lines, until the strips 16 and 16' mate with the central portion or base 4, the strips 14 and 14' mate with the strips 6 and 6' respectively, and the strips 10 and 10' mate with the strips 18 and 18', these latter resting one against the other.

Simultaneously with said folding operation, the sheet is provided with suitable adhesive zones intended to ensure the transverse consistency of the beam 101.

In this manner, a tubular element is obtained having elevated properties of resistance to bending, to transverse crushing and to deformation of its cross-section, and of which the configuration and component elements are clearly visible in FIG. 1.

From said figure it can be seen that the cross-section of the beam has an overall rectangular configuration which is divided into two adjacent symmetrical half sections which mate along the vertical longitudinal plane of symmetry through said beam.

Furthermore, each half section comprises two triangular configurations which in the case of the left hand half section are defined by the strips 8, 10 and 12, and by the strips 16, 14 and 12 respectively.

The two triangular configurations are connected together by a common diagonal constituted by the strip 12, and are mutually inverted.

Finally, it is apparent that by suitably sizing the width of the component strips it is possible to obtain a beam 101 having an overall section different from that shown, for example square or of isosceles trapezium form, this latter constituted by two adjacent half sections of rectangular trapezium configuration.

Using the tubular element portions according to the invention, disposable pallets or load-carrying platforms, or platforms for storing goods can for example be constructed, together with other structures for uses other than the preceding.

Figure 3:
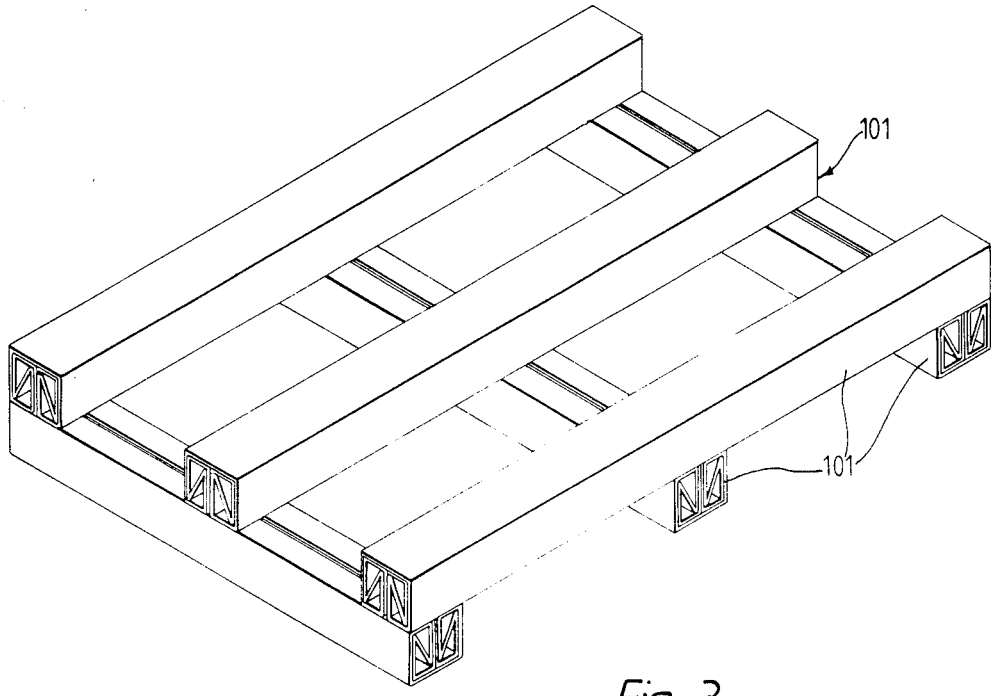
FIG. 3 is a perspective view of a pallet or load-carrying platform constructed with a tubular element according to the present invention.

One of said pallets is shown in perspective view in the accompanying FIG. 3.

The invention is not limited to the single embodiment heretofore described, and modifications and improvements can be made thereto without leaving the scope of the invention, the fundamental characteristics of which are summarised in the following claims.

I claim:

1. A tubular beam of folded corrugated cardboard which has a high resistance to bending and to transverse crushing comprising a single corrugated cardboard sheet (1) having its corrugations orthogonal to its longitudinal axis (2), said sheet (1) being folded back several times on itself parallel to its axis (2) to form an overall section of right angled configurations (4, 6', 8', 8, 6), and divided into two adjacent half sections (4, 6', 8', 18') - (4, 6, 8, 18), which mate along the longitudinal symmetrical axis of the beam 17, 17', and which each comprise two triangular channel configurations (16', 14', 12') - (8', 10', 12'), (10, 8, 12) - (16, 14, 12) which mate along a common diagonal (12'), (12), and are mutually inverted.

2. The tubular beam as claimed in claim 1, wherein said single cardboard sheet (1), arranged to constitute said overall section of right angled configurations (4, 6', 8', 8, 6) is of constant width and indeterminate length, and comprises, on both sides of a longitudinal central portion (4), seven predetermined creasing lines (3, 5, 7, 9, 11, 13, 15) - (3', 5', 7', 9', 11', 13', 15'), of which the first four lines (3, 5, 7, 9) - (3', 5', 7', 9') are concordant with respect to their folding direction and the other three lines (11, 13, 15) - (11', 13', 15') are discordant with the preceding four lines (3, 5, 7, 9) - (3', 5', 7', 9'); said lines defining, starting from said central portion (4), a first (6, 6'), a third (10, 10'), a fifth (14, 14') and a seventh (18, 18') strip having a width substantially equal to the height of the beam (101), a fourth strip (12, 12') having a width substantially equal to the common diagonal of the triangular channel configurations, and a second strip (8, 8'), and a sixth strip (16, 16') having a width substantially equal to one half the width of the beam.

3. The tubular beam as claimed in claim 1, wherein the first three strips (6, 8, 10), (6', 8', 10') of each set provided on each side of said central portion (4) are bent towards the latter to define a beam half section comprising a first configuration of rectangular cross-section, within which there extends in opposite directions from said common diagonal (12, 12'), as a fourth strip, an internal configuration of triangular cross-section which emerges from said first rectangular configuration by way of the seventh and last strips (18, 18'), which mate with the corresponding last strip (18', 18) of the other half section.

4. The tubular beam as claimed in claim 1, wherein between the contacting faces of said strips which compose the two half sections there are provided adhesive zones arranged to ensure the consistency of said overall right angled configurations (4, 6', 8', 8, 6).

5. The tubular beam of claim 1 wherein the sheet contains fifteen longitudinal fold lines which continually fold inwardly toward each other at right angles and acute angles to define two adjacent mirrored square cornered sections, each containing a diagonal member which subdivides each square cornered sections into said two mutually inverted triangular channels.

6. A tubular beam of folded corrugated cardboard which has a high resistance to bending and to transverse crushing comprising a four, square cornered member, longitudinally subdivided into two, four square cornered members, each of said two members being further subdivided by a diagonal into two, mutually inverted, triangular channels, whereby the tubular beam has one side of substantially one thickness, three sides of two thicknesses, a longitudinally subdividing member of four thicknesses and two diagonal members of one thickness.

* * * * *